United States Patent [19]

Rolston

[11] Patent Number: 4,775,434

[45] Date of Patent: Oct. 4, 1988

[54] RESIN-STRIPPING DIE

[76] Inventor: J. Albert Rolston, 1371 Pleasant Vally Rd., Newark, Ohio 43055

[21] Appl. No.: 8,941

[22] Filed: Jan. 30, 1987

[51] Int. Cl.[4] ..... B05C 3/02

[52] U.S. Cl. ..... 156/425; 57/352; 57/356; 118/125; 118/234; 118/246; 118/405; 242/157 R; 242/157.1

[58] Field of Search ..... 156/430, 425; 242/137.1, 140, 157 R, 157.1; 112/302; 57/352, 356, 357; 118/125, DIG. 18, 234, 246, 405

[56] References Cited

U.S. PATENT DOCUMENTS

| | | | |
|---|---|---|---|
| 1,771,923 | 7/1930 | Hendrickson et al. | 242/157 R |
| 1,882,459 | 10/1932 | Tyner | 118/125 |
| 2,193,887 | 3/1940 | Seeley | 118/125 |
| 2,366,077 | 12/1944 | Wildy et al. | 118/125 |
| 2,881,732 | 4/1959 | Chrystman | 118/33 |
| 2,960,063 | 11/1960 | Martuch | 242/157 R |
| 3,251,339 | 5/1966 | Whitfield | 118/122 |
| 3,874,329 | 4/1975 | McLarty | 118/125 |
| 4,194,462 | 3/1980 | Knowles | 118/DIG. 18 |
| 4,267,007 | 5/1981 | Kellogg | 118/234 X |

FOREIGN PATENT DOCUMENTS

| | | | |
|---|---|---|---|
| 845433 | 8/1960 | United Kingdom | 118/125 |

OTHER PUBLICATIONS

Fiberglas Bulletin entitled, Filament Winding with Type 30 Roving (Pub. No. 5-CR-6516), published sometime in the 70's.

*Primary Examiner*—David Simmons
*Attorney, Agent, or Firm*—Sidney W. Millard

[57] ABSTRACT

A resin-stripping die for mounting in a holder on a filament winding machine comprising a body formed of resiliently flexible heat and wear resistant material with a converging, preferably tubular, passage which is slit longitudinally at one side throughout its full length to permit lateral movement of the die onto and off a filament strand. In operation, the die is mounted in a fixed axial position in the holder.

12 Claims, 3 Drawing Sheets

RESIN-STRIPPING DIE

FIELD OF THE INVENTION

This invention relates to impregnation of filaments or strands with liquid resin, stripping the excess resin from the strands and winding the strands on a mandrel.

BACKGROUND OF THE INVENTION

This invention relates to a resin-stripping die used in filament-winding processes in which resin-impregnated strands of continuous glass fiber rovings are wrapped around a mandrel and subsequently cured. The present state of the art in filament winding and impregnating of strands of glass fibers is dislosed in an Owens-Corning Fiberglas Bulletin entitled Filament Winding With Type 30 Roving (Pub. #5-CR-6516). This bulletin discloses in FIG. 9 one of the most common commercial processes for impregnation of the glass fibers wherein the strands are fed across a moving roll and pick up a given amount of resin. That Bulletin specifically discusses a resin-stripping orifice to remove excess resin, such resin stripping apparatus have been used in the prior art.

In filament winding, pultrusion and other processes, it is desirable to saturate the fibrous strands of glass or other fibers with resin or other plastisol before forming them into the shape of the final article. The excess resin then needs to be removed. In most filament winding operations, the excess is often squeezed off by rubber squeegees which add tension and may cause strand breakage. Such conventional apparatus leaves undesirable excess resin to be wasted or collected mechanically or manually when it drips off the mandrel.

Prior art stripping dies used to remove excess resin are usually of a type difficult to thread. Experiments have shown that round cross-section dies give the lowest back tension and less strand breakage. One such prior art die is disclosed by U.S. Pat. No. 2,960,063 to Martuch. This die consists of half-cone members which form an opening or passage through which a glass strand is passed in order to remove excess resin. These half-cone members are adjustable relatively to vary the size of the strand passage so as to vary the size of the strand along its length. As the strand moves through the passage, it tends to spread laterally thorugh the split between the die halves and the resin will also escape through the split. Thus, there will be a distortion of the cross-sectional shape of the strand and the resin will not be applied uniformaly thereto to provide a strand of circular cross-section with a uniform coating of predetermined thickness. Also, this die could not be readily slipped over a strand due to the complicated and cumbersome adjustable mounting for the two halves.

The main problem for conventional stripping dies is to prevent excess resin on strands leaving the impregnation bath. With conventional stripping dies the impregnated bundle of fibers or strands comprises about 50% by weight of resin which is about 70% of the volume.

For purposes of this disclosure the fibers or strands to be impregnated or coated include glass fiber, aramid, graphite or any other fibers needing such treatment.

For purposes of this disclosure the impregnating or coating resin may be epoxy, vinyl ester, polyester and the like.

SUMMARY OF THE INVENTION

The present invention provides a resin-stripping die through which a strand of resin-impregnated glass fiber is to be passed to form the strand into a selected cross-section and to remove excess resin so that when wound around a mandrel there will not be an excess of resin which must be removed from the formed article. The die of this invention is made of a resiliently flexible material which is capable of withstanding high temperature and is wear-resistant. The material is also of such a nature that it will produce a sufficient back tension for the mandrel winding process but not excessive back tension which might cause strand breakage. The die is of spilt tubular form with a strand passage formed therein of suitable cross-section converging from its inlet end to its outlet end. The die is split outwardly at only one side of the passage, the split extending the full length of the die. By reason of the split, the die can be slipped radially over the strand reinforcement. After positioning on the strand, the die can be slipped into a holder which closes the split and provides a converging passage through which the strand passes to produce a strand of uniform cross-section with only the desired amount of resin coating.

With the apparatus of this invention the excess resin stripped from the coated strands results in a strand which is about 25–30% by weight of resin which is about 50% of the volume.

BRIEF DESCRIPTION OF THE DRAWINGS

The best mode contemplated in carrying out this invention is illustrated in the accompanying drawings in which.

DETAILED DESCRIPTION OF THE INVENTION

With reference to the drawings, there is illustrated in FIGS. 1–4 a filament winding machine with which the unique resin stripping die of this invention can be used. FIGS. 5 and 6 illustrate the form of the die itself before it is mounted on the machine.

The general structure of the winding machine is similar to filament winding machines now in commercial use. The machine is shown as comprising a tank 10 which is suitably supported on a frame 11 to provide a receptacle for the resin bath indicated at B. The machine receives individual strands of glass or other fiber from a creel which are passed through the machine to be impregnated with the resin from the bath B which and emerge from the machine impregnated with the proper amount of resin and of desired cross-section and under suitable tension to be wound on a receiving mandrel M.

Figure 1:
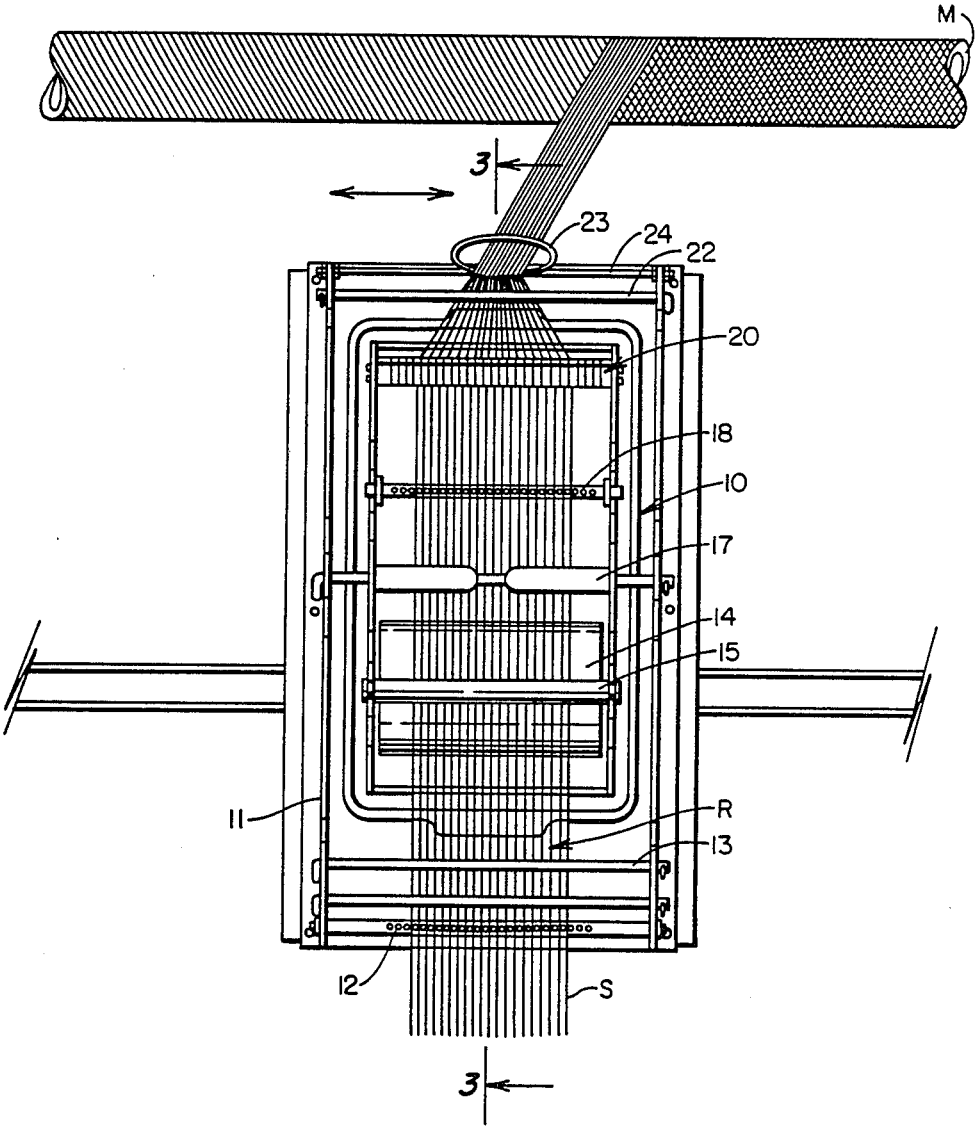
FIG. 1 is a schematic plan view of a filament winding machine including a filament feed, resin impregnation bath, resin stripping apparatus and feeding apparatus for directing the impregnated fibers to a mandrel.
Figure 2:
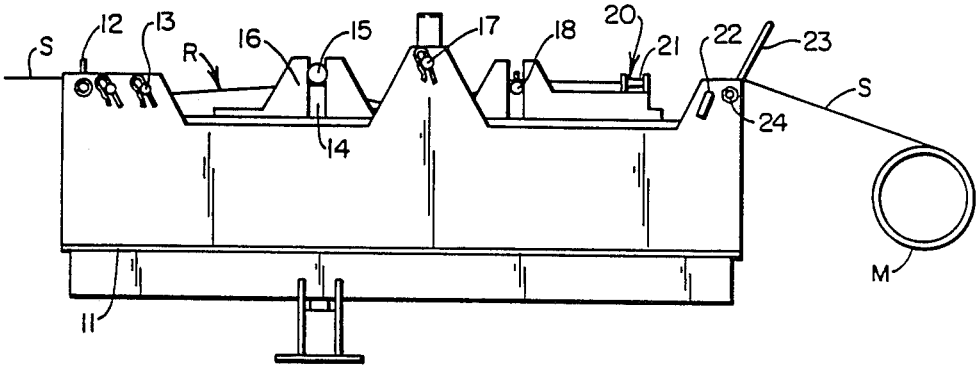
FIG. 2 is a side elevational view of the machine of FIG. 1.
Figure 3:
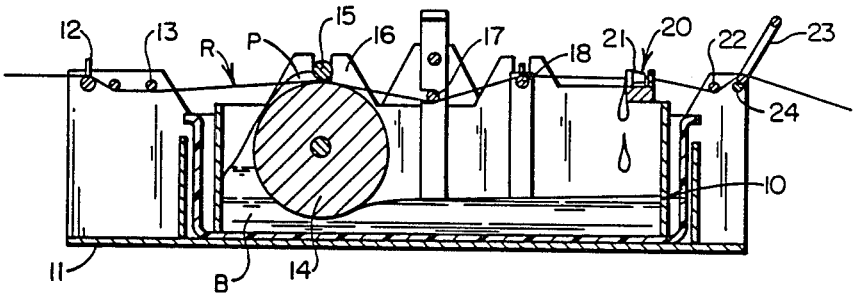
FIG. 3 is a sectional view through the machine taken along line 3—3 of FIG. 1.

A number of individual strands or bundles of individual strands S will be received from the creel and will be properly spaced by a transverse comb 12 or similar device into a roving band R as they enter the machine. The comb 12 may be suitably supported by the frame 11 at the inlet end of the machine. The rovings R then may pass under transverse bars 13 supported by the frame 11 in longitudinally spaced relationship. Then the rovings may pass over the resin-applying roller 14 and may be held down in engagement with the roller 14 by means of a pressure bar or roller 15. The roller 14 is carried at a fixed level in the resin bath on a transverse axle for rotation in the bath B of the resin in which its lower portion is positioned as shown in FIG. 3. The bar 15 is mounted in vertical guides 16 so that its weight will press the rovings down onto the roller 14. Thus, as the rovings R passes between these rollers, the roller 14 will be rotated to pick up resin from the bath B to impregnate the roving strands S with an excess amount of resin. Then the rovings with the resin applied thereto may be passed under a transverse two-part bar or roller 17 supported on the frame 11, and then through a transverse comb 18 which is also suitably supported on the frame 11. This comb 18 will maintain the spacing of the resin impregnated bundles of strands S of the roving band R.

Looking to FIG. 3, the pattern of the surface structure of the resin B in tank 10 is of some significance. It provides a cost savings by its pattern in combination with the other structural elements of the machine. The desire to minimize excess resin leaving the bath is at least twofold. First, the dripping of the excess resin from the mandrel creates a mess and clogs the machinery. Second, the resin is often the most expensive ingredient in the process and minimizing its consumption and stored volume saves money. The stripping dies to be described subsequently perform a needed function. However, the unique combination of elements in the impregnation tank 10 minimize the amount of stored resin in the system.

To give some perspective not necessarily apparent from the drawings, tank 10 may be roughly the size of a small plastic dish pan, for example, twelve inches by twenty-four inches. The roller 14 might be six inches in diameter by ten inches long. The mandrel M may be as much as twenty feet long.

In operation, the need is to submerge the lower edge of the roller while using a minimum volume of resin. Thus, the bottom of tank 11 is inclined downwardly toward the left-hand end as shown in FIG. 3 at an angle of 2° to 3°. A curved depression (not shown) under the roller could be used also. The viscous resin will be pulled under roller 14 to collect against the adjacent tank wall and insure a good roller coating as it rises to engage the strands S. The pressure bar 15 separates most of the resin carried by the rising roller 14 from the saturated strands S and sustains a puddle P adjacent the convergence of the bar 15 and roller 14 and thereby insures a greater saturation of the strands than with some conventional apparatus. As the strand leaves the roller 14 it will have picked up resin in excess of about 50% of its dry weight.

The roving strands R are next passed through a bank of dies 20 mounted in suitable holders 21 at the outlet end of the resin impregnating machine where excess resin is stripped from the strands. The stripped strands S may be passed under a bar 22 suitably supported transversely on the frame 11 and then upwardly through an upstanding gathering loop 23 which is supported for oscillation at the outlet end of the machine by a transverse bar 24. This loop gathers the strands of the roving into a narrower flat band and oscillates back and forth on the bar 24 to wind the strands on the mandrel M in conventional manner.

Figure 4:
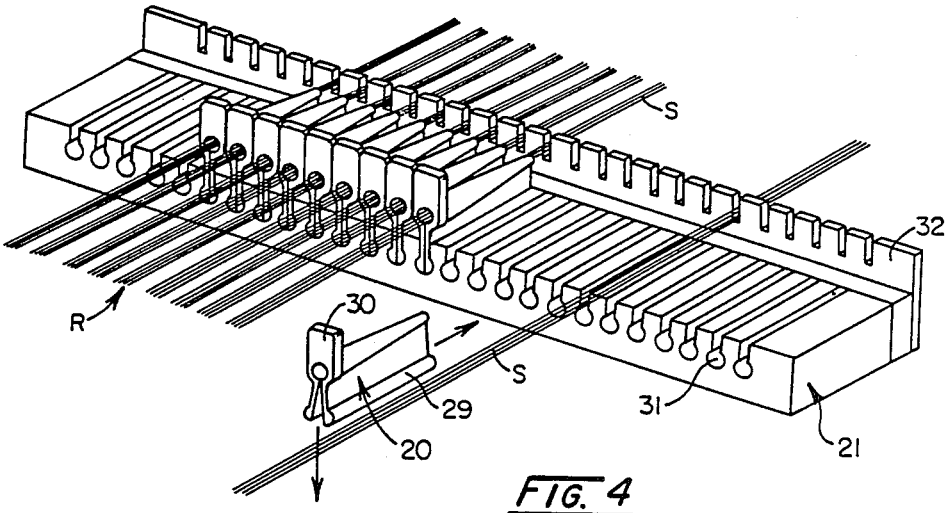
FIG. 4 is a perspective view showing the mounting of a plurality of resin-stripping dies in a bank of holders on the machine.
Figure 5:
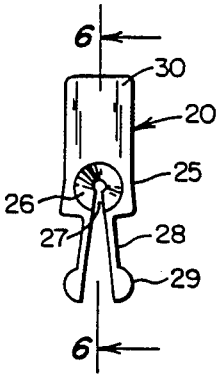
FIG. 5 is a front elevational view of one of the dies of FIG. 4.
Figure 6:
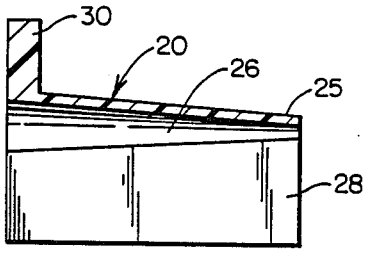
FIG. 6 is a sectional view taken along line 6—6 of FIG. 5.

Each of the dies 20 of the die bank is illustrated best in FIGS. 5 and 6 which show a die removed from the holder 21 which is shown best in FIG. 4. Each die comprises an elongated body 25 which has a passage 26 that converges from its inlet end to its outlet end. The passage is preferably substantially conical but is split only at one side at 27 for its full length. The material of the die is resilient so that the slit 27 can be widened or narrowed, but normally the slit will be open as indicated in FIG. 5. Associated with the slit are the two outwardly extending flanges 28 which will facilitate widening the slit or closing it from the condition shown in FIG. 5. The flanges 28 have semi-circular lips 29 there along for reasons to be explained subsequently. Also extending outwardly from the die body 25 is a lug 30 which is located opposite the flanges 28. The lug 30 prevents resin build-up from passing over the die, acting as a dam to hold back the excess resin. Additionally, lug 30 provides an easy grasping handle for inserting or removing the die 25 from the socket 31 in holder 21. By way of example, if a knot in a bundle of strands S could not pass through the die 20, the strand S would break; to rethread that strand, the lug could be grasped by pliers or by hand and pulled longitudinally from socket 31 until the flanges spring open; then the strand can be inserted transversely into the passage 26 and the die 20 reinserted into the socket 31.

As indicated before, the die is of a resilient or flexible material such as a theremoplastic resin, stainless steel, etc. However, in actual practice it has been found that high or ultrahigh molecular weight polyethylene with a molecular weight of at least 200,000 is most suitable. This material will effectively resist abrasive wear and heat but will still permit the development of suitable tension on the strand S as it is wound on the mandrel M without developing excessive back tension to cause breakage. Said polyethylene is useful up to about 200° F. in most applications.

Before mounting on the holder 21, the flanges 28 of each die are squeezed together to close the slit 27 and then the die is slipped into a socket 31 on the holder 21. These sockets 31 are of keyhole form in cross-section and are disposed in parallel relationship to receive the parallel strands S. Each socket has the circular cross-section lower portion for receiving the semi-circular lips 29 and an upper slot portion for receiving the flanges 28. As indicated in FIG. 4, the die may be slipped downwardly over a strand S, the flanges 28 pressed together, and then the die moved downstream into a socket 31 of the holder. The passage 26 will now be of conical form with its wider end being the inlet end facing upstream. The die may thereafter be easily removed by sliding it upstream out of the holder socket 31 for replacement.

As its downstream side, the holder 21 may have an upstanding comb 32 for maintaining the spacing of the strands S and aligning the same with comb 18 and the axis of cone 26.

As each strand S is pulled through the conical die passage 26, it is gradually compressed and formed into circular cross-section and excess resin is stripped from its surface and drops into the bath B as shown in FIG. 4. When the die wears to an undesirable condition, it can be readily slipped upstream from the holder by engaging lug 30 and be replaced with a new die. The die can be readily slipped off the strand and a new die can be readily slipped thereon.

An interesting feature of die stripping using the cone shaped stripping die is that for best results the strands entering and leaving the die must be aligned. That is, a linear passage through the die is critical for best results. If there is radial pulling, the die tends to such air and considerable frothing of the stripped resin results. The froth drops back into the tank 10 and eventually returns to the process to impair the coating process of roller 14. Accordingly, aligning combs 18 and 32 are critical to most efficient operation of the impregnating bath.

Having thus described the process of this invention it will be clear to those having ordinary skill in the art that modifications may be made in certain features of the invention. It is not intended that the words used to describe the invention in the description portion above be limiting on the invention. Rather, it is intended that the invention be limited only by the scope of the appended claims.

I claim:

1. In an apparatus for impregnating a bundle of fibers with a liquid resin including a resin-stripping die having a converging strand passage extending longitudinally therethrough and a slit at only one side of the die body extending to said passage and longitudinally throughout the length of the die and means holding the die in operative position, the improvement comprising:

(a) outwardly extending flanges projecting from the die parallel with said slit and terminating in a symmetric lip therealong;

(b) a tab extending upwardly within the plane of the wider end of the coverging liquid-stripping die passageway providing means for grasping and manipulating the die; and (c) said holding means comprising a holder with a keyhole socket and an upper slot portion disposed in parallel relationship to receive the symmetric lip of the die flanges in compressive alignment.

2. The apparatus of claim 1 wherein the body of the converging resin-stripping die is of a resiliently flexible material.

3. The resin-stopping die of claim 2 wherein the body of the die is formed of polyethylene having a molecular weight of at least 200,000.

4. The resin-stripping die of claim 3 wherein the polyethylene body can be modified to accommodate variable strand loading thereby resulting in coated strands of about 25–30% by weight of resin.

5. The apparatus according to claim 1 in which the body of the die is formed of polyethylene having a molecular weight of at least 200,000.

6. The apparatus according to claim 1 in which the body carrier outwardly-extending flanges at each side of the slit, said flanges extend longitudinally substantially the full length of the slit to facilitate spreading and closing of the die slit.

7. The apparatus of claim 1 further including, a resin bath and means for pulling a bundle of fibers through the bath to absorb greater than about 50% by weight of resin, said bath including a tank having a bottom and sidewalls to hold the resin, a roller rotably mounted in said tank and partially immersed in said resin, said roller and one sidewall being configured to confine resin therebetween and draw resin above the top of said roller as said roller rotates, means for pressing said fibers against the top of said roller to insure complete coating of said fibers by the resin drawn above the top of said roller, means for pulling the bundle from the bath and directing said bundle linearly through the stripping die, said die being located above said tank whereby resin stripped from said fibers by said die falls by gravity into said tank, the weight of resin remaining on the fibers after passing said die being not greater than about 25–30%, means for winding the stripped bundle on a mandrel, said die including a body with a cone shaped fiber bundle passage extending longitudinally therethrough.

8. The apparatus according to claim 7 in which the body of the die is formed of ultrahigh molecular weight polyethylene.

9. The apparatus according to claim 8 in which the means for receiving includes a holder which has a complemental socket open at one end and partially closed at the other end for receiving the flanges of the die longitudinally thereinto.

10. The apparatus of claim 7 including means associated with said die for preventing downstream migration of resin stripped from said fibers.

11. The apparatus of claim 10 wherein said downstream migration peventing means comprises a flange around the upstream end of said die.

12. The apparatus of claim 7 including a plurality of said dies arranged to be mounted in said receiving means, each said die including a flange for manual grapsing for pulling said die from said receiving means without moving the remainder of said dies.

* * * * *